US008212544B2

(12) United States Patent
Kang et al.

(10) Patent No.: US 8,212,544 B2
(45) Date of Patent: Jul. 3, 2012

(54) SEMICONDUCTOR INTEGRATED CIRCUIT HAVING LEVEL REGULATION FOR REFERENCE VOLTAGE

(75) Inventors: Shin-Deok Kang, Ichon (KR); Ja-Seung Gou, Ichon (KR)

(73) Assignee: SK hynix, Inc. (KR)

( * ) Notice: Subject to any disclaimer, the term of this patent is extended or adjusted under 35 U.S.C. 154(b) by 1016 days.

(21) Appl. No.: 12/167,951

(22) Filed: Jul. 3, 2008

(65) Prior Publication Data

US 2009/0045796 A1 Feb. 19, 2009

(30) Foreign Application Priority Data

Aug. 13, 2007 (KR) ..... 10-2007-0081029
Dec. 10, 2007 (KR) ..... 10-2007-0127483

(51) Int. Cl.
*G05F 3/16* (2006.01)
*G05F 3/20* (2006.01)
*G05F 1/10* (2006.01)
*G05F 3/02* (2006.01)

(52) U.S. Cl. ..... 323/313; 327/538; 327/539; 327/540

(58) Field of Classification Search ..... 323/313, 323/318
See application file for complete search history.

(56) References Cited

U.S. PATENT DOCUMENTS 5,461,584 A * 10/1995 Ikuta et al. ..... 327/516
5,563,546 A * 10/1996 Tsukada ..... 327/408
6,153,081 A 11/2000 Fukui et al.
6,178,109 B1 1/2001 Song et al.
6,310,796 B1 10/2001 Song
6,507,183 B1 * 1/2003 Mulatti et al. ..... 324/99 D
7,683,695 B2 * 3/2010 Sousa et al. ..... 327/382
2001/0004126 A1 * 6/2001 Ohlhoff ..... 257/528
2005/0077923 A1 * 4/2005 Kim et al. ..... 327/50
2007/0070721 A1 * 3/2007 Kim ..... 365/189.09

FOREIGN PATENT DOCUMENTS

JP 2000-182375 6/2000
JP 2007-068176 3/2007
KR 1019980075712 11/1998
KR 100232890 B1 9/1999
KR 1020020091958 A 12/2002
KR 1020060027436 A 3/2006
KR 100728557 6/2007

* cited by examiner

*Primary Examiner* — Adolf Berhane
*Assistant Examiner* — Emily Pham
(74) *Attorney, Agent, or Firm* — Baker & McKenzie LLP

(57) ABSTRACT

A semiconductor integrated circuit can include a reference voltage pad that can be configured to receive an external reference voltage and supply the external reference voltage to the inside of the semiconductor integrated circuit, an internal reference voltage generator that can be configured to generate an internal reference voltage by voltage dividing, a selector that can be configured to select and output one of the external reference voltage and the internal reference voltage in response to a selection signal, and a voltage trimming block that can be configured to regulate the level of the output voltage from the selector in response to trimming signals and outputs the level-regulated voltage as a reference voltage.

12 Claims, 8 Drawing Sheets

SEMICONDUCTOR INTEGRATED CIRCUIT HAVING LEVEL REGULATION FOR REFERENCE VOLTAGE

CROSS-REFERENCE TO RELATED PATENT APPLICATION

The present application claims priority under 35 U.S.C. 119(a) to Korean application numbers 10-2007-0081029, filed on Aug. 13, 2007 and 10-2007-0127483, filed on Dec. 10, 2007, in the Korean Intellectual Property Office, the contents of which are incorporated herein in their entireties by reference as if set forth in full.

BACKGROUND

1. Technical Field

The embodiments described herein relate to a semiconductor integrated circuit, and more particularly to a semiconductor integrated circuit for finely regulating reference voltage.

2. Related Art

In general, a semiconductor memory apparatus receives power supply voltages, such as an external power supply voltage VDD and a ground power supply voltage VSS, and generates and uses internal voltages, such as a reference voltage Vref, a peripheral voltage Vperi, a core voltage Vcore, a boost voltage VPP, and a substrate bias voltage VBB. Typically, voltage generating circuits that generate internal voltages are included in the semiconductor memory apparatus. Alternatively, the reference voltage Vref can be provided from the outside through a pad. The reference voltage Vref is mainly used to provide a reference for discriminating the logic value of a signal in a data input buffer.

Referring to FIG. 1, a conventional semiconductor integrated circuit includes a reference voltage pad 10, and first to n-th input buffers 20-<1:*n*> (where n is a natural number).

The reference voltage pad 10 receives an external reference voltage evref and supplies the external reference voltage evref to the first to n-th input buffers 20-<1:*n*>. The first to n-th input buffers 20-<1:*n*> buffer data by using the external reference voltage evref.

The external reference voltage evref needs to be maintained at a predetermined level. However, an increase in swing speed of signals that are received by the semiconductor integrated circuit may cause an increase in power consumption. Then, power noise may occur and accordingly the level of the external reference voltage evref may be changed. If power noise occurs, the levels of voltages output from the first to n-th input buffers 20-<1:*n*> may be distorted due to noise. If the level of the reference voltage to be internally used is distorted, an error may occur in the operation to discriminate the logic value of a signal. In addition, the change in the level of the reference voltage may lead to a change in the setup/hold time of the signal. For this reason, the operation stability of the semiconductor integrated circuit may be deteriorated.

SUMMARY

A semiconductor integrated circuit which suppresses noise influences from the outside and uses a stable reference voltage is described herein.

According to one aspect, a semiconductor integrated circuit can include: a reference voltage pad that is configured to receive an external reference voltage and supply the external reference voltage to the inside of the semiconductor integrated circuit; an internal reference voltage generator that is configured to generate an internal reference voltage by voltage dividing; a selector that is configured to select and output one of the external reference voltage and the internal reference voltage in response to a selection signal; and a voltage trimming block that is configured to regulate the level of the output voltage from the selector in response to trimming signals and outputs the level-regulated voltage as a reference voltage.

According to another aspect, a semiconductor integrated circuit can include: a reference voltage pad that is configured to receive an external reference voltage; an internal reference voltage generator that is configured to generate a plurality of internal reference voltages by voltage dividing in response to a voltage change signal; a trimming block that is configured to output one of the plurality of internal reference voltages as a reference voltage; and a reference voltage supply unit that is configured to output the external reference voltage as the reference voltage, in response to the voltage change signal.

According to still another aspect, a semiconductor integrated circuit can include: a reference voltage pad that is configured to receive an external reference voltage; a common node to which a reference voltage is applied; an internal reference voltage generator that is configured to generate a plurality of internal reference voltages by voltage dividing in response to a voltage change signal; a trimming block that is configured to supply one of the plurality of internal reference voltages to the common node; and a reference voltage supply unit that is configured to shift down the level of the external reference voltage and supply the level-shifted external reference voltage to the common node.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
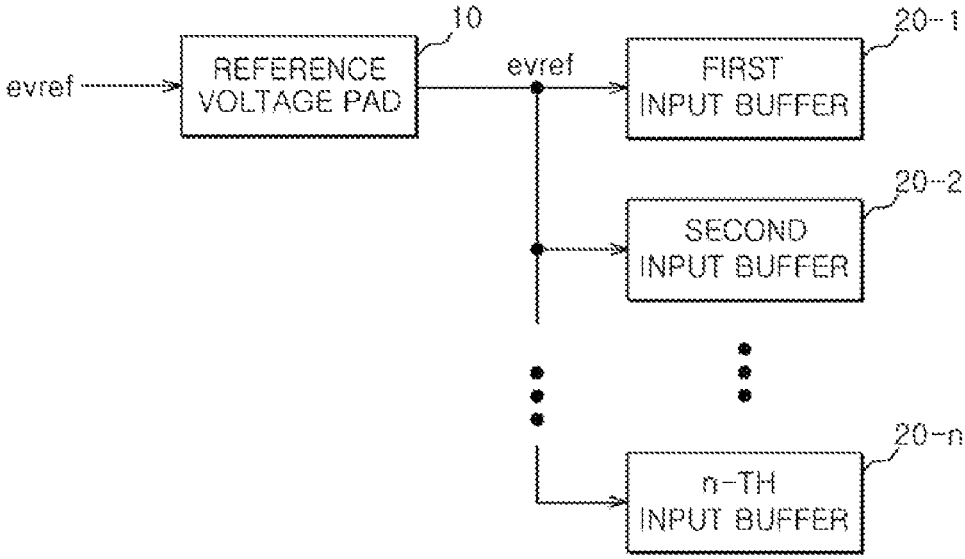
FIG.1 (PRIOR ART)
FIG. 1 is a block diagram of a semiconductor integrated circuit according to related art.
Figure 2:
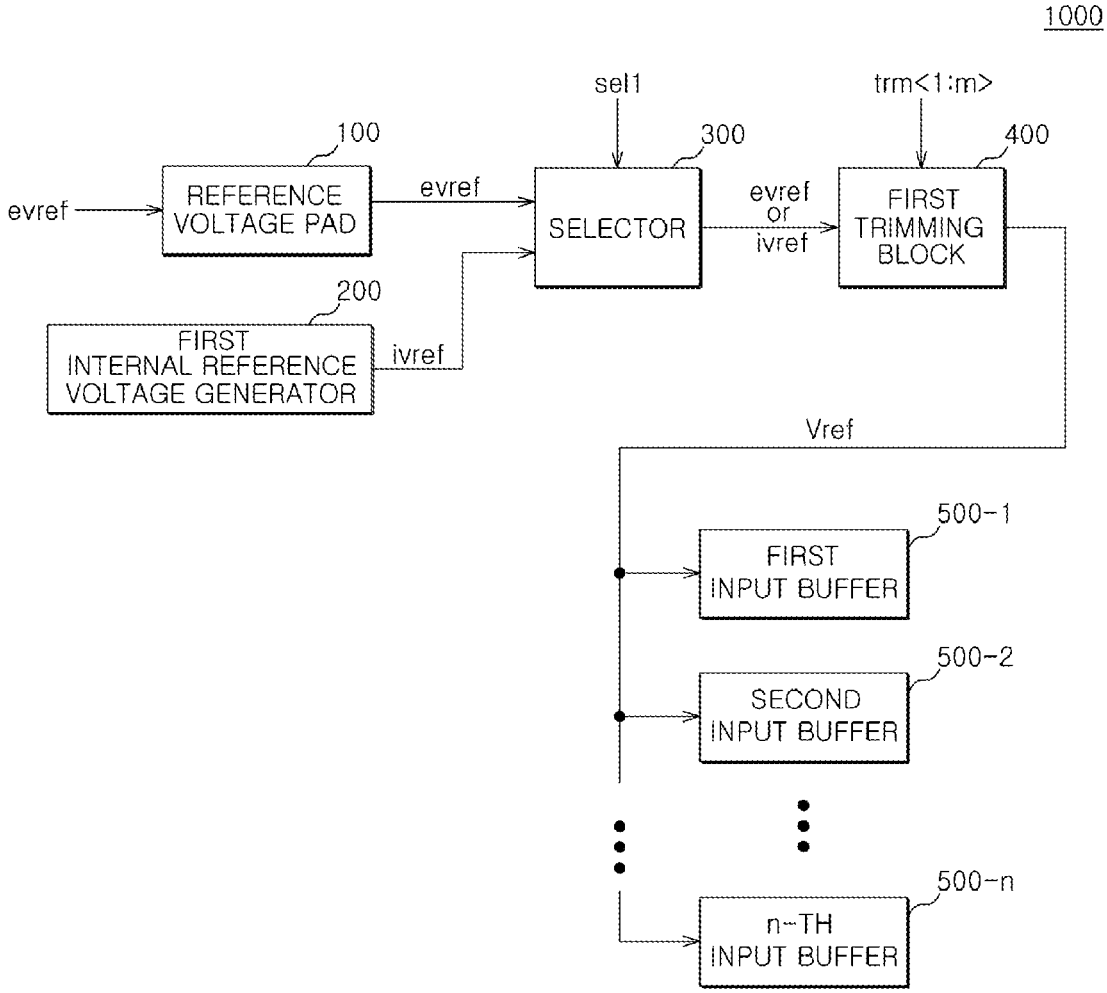
FIG. 2 is a block diagram illustrating the configuration of a semiconductor integrated circuit, in accordance with one embodiment.

FIG. 2 is a diagram illustrating a semiconductor integrated circuit 1000 according to one embodiment. Referring to FIG. 2, the semiconductor integrated circuit 1000 can include a reference voltage pad 100, a first internal reference voltage generator 200, selector 300, a first trimming block 400, and first to n-th input buffers 500-<1:*n*>.

The reference voltage pad 100 can be configured to receive an external reference voltage evref and supply the external reference voltage evref to the inside of the semiconductor integrated circuit. The first internal reference voltage generator 200 can be configured to generate an internal reference voltage ivref by dividing an external power supply voltage VDDQ (Refer to FIG. 3).

The selector 300 can be configured to select and output one of the external reference voltage evref and the internal reference voltage ivref in response to a first selection signal 'sel1.' The first selection signal 'sel1' can be implemented with a signal generated according to whether or not a fuse is short-circuited, a signal from an 'MRS' (Mode Register Set), or a signal is received from the outside during a test mode.

The first trimming block 400 can be configured to regulate the level of the output voltage of the selector 300 in response to first to m-th trimming signals 'trm<1:m>' (where m is a natural number) and output the level-regulated voltage as a reference voltage Vref. The first to m-th trimming signals 'trm<1:m>' can be implemented such that one of the m signals is at a first level (for example, low level). Similarly to the first selection signal 'sel1,' the first to m-th trimming signals 'trm<1:m>' can be implemented with signals generated according to whether or not fuses are short-circuited, signals from the MRS, or signals are received from the outside during the test mode.

The first to n-th input buffers 500-<1:*n*> buffer data by using the reference voltage Vref.

As such, the semiconductor integrated circuit 1000 can include the first internal reference voltage generator 200 and generate the internal reference voltage ivref by means of the first internal reference voltage generator 200, in accordance with one embodiment. Thereafter, one of the external reference voltage evref and the internal reference voltage ivref input through the reference voltage pad 100 can be selected, and the level of the selected voltage is trimmed according to the control of the first to m-th trimming signals 'trm<1:m>,' thereby generating the reference voltage Vref. With this configuration, when the external reference voltage evref is influenced by noise, the semiconductor integrated circuit 1000 can be configured to use the internal reference voltage ivref, instead of the external reference voltage evref. Therefore, the stable reference voltage Vref can be generated. In addition, since the first trimming block 400 can be configured to finely regulate the level of the reference voltage Vref, the reference voltage Vref can be further stabilized.

Figure 3:
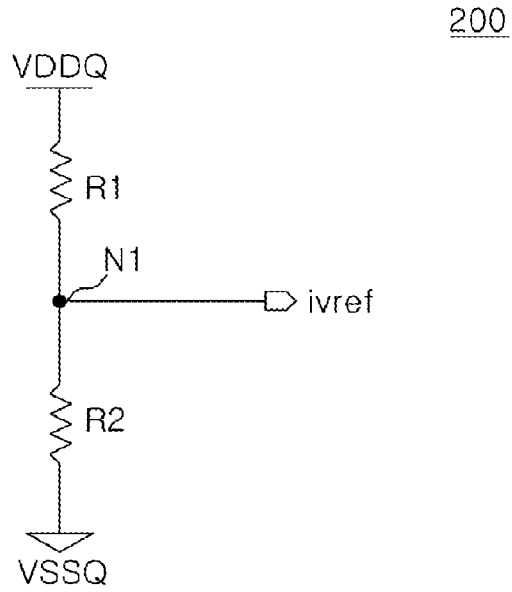
FIG. 3 is a diagram illustrating the detailed configuration of a first internal reference voltage generator that can be included in the circuit illustrated in FIG. 2, in accordance with one embodiment.

Referring to FIG. 3, the first internal reference voltage generator 200 can include first and second resistors R1 and R2 that are connected in series between the supply terminal of an external power supply voltage VDDQ and a supply terminal of a ground power supply voltage VSSQ. To a first node N1 between the first resistor R1 and the second resistor R2, a voltage which can be generated by voltage divided according to a resistance ratio of the first resistor R1 and the second resistor R2 is applied. This voltage can be output as the internal reference voltage ivref.

The external power supply voltage VDDQ and the ground power supply voltage VSSQ can be power supply voltages for the input/output buffers.

The levels of the external power supply voltage VDDQ and the ground power supply voltage VSSQ, which can be supplied to the first to n-th input buffers 500-<1:*n*>, can be changed due to noise. In this case, the level of the internal reference voltage ivref can be changed in connection with the external power supply voltage VDDQ and the ground power supply voltage VSSQ. Accordingly, when the internal reference voltage ivref is used to generate the reference voltage Vref, since the first to n-th input buffers 500-<1:*n*> operate with the reference voltage Vref which is level-changed in connection with the power supply voltages, a buffering operation of input data can be performed stably.

Figure 4:
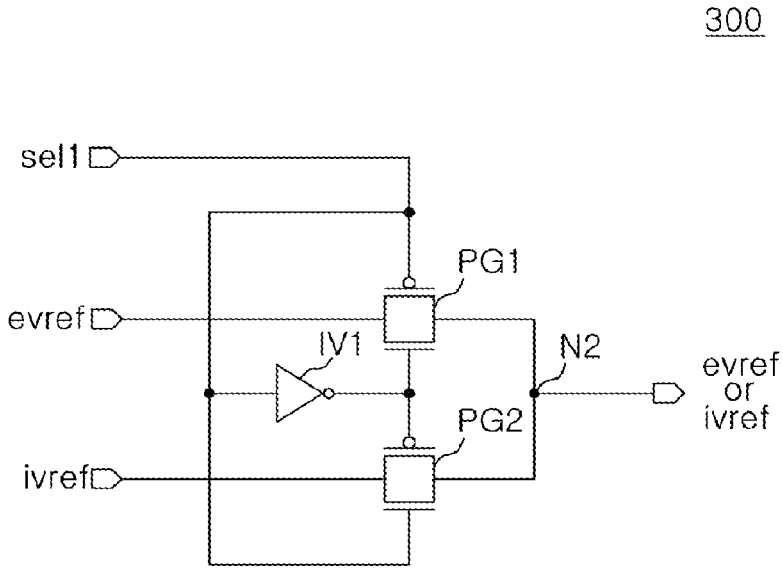
FIG. 4 is a diagram illustrating the detailed configuration of a selector that can be included in the circuit illustrated in FIG. 2, in accordance with one embodiment.

Referring to FIG. 4, the selector 300 can include a first pass gate PG1, a second pass gate PG2, and a first inverter IV1.

The first inverter IV1 can be configured to receive the first selection signal 'sel1.' The first pass gate PG1 can be configured to transmit the external reference voltage evref to a second node N2 in response to the first selection signal 'sel1' and an output signal of the first inverter IV1. The second pass gate PG2 can be configured to transmit the internal reference voltage ivref to the second node N2 in response to the first selection signal sel1 and the output signal of the first inverter IV1. To the second node N2, one of the external reference voltage evref and the internal reference voltage ivref can be applied, and the applied voltage can be transmitted to the first trimming block 400.

Preferably, the voltage level of the first selection signal 'sel1' becomes a high level when a significant amount of noise flows into the external reference voltage evref, and it becomes a low level when little noise flows into the external reference voltage evref. Accordingly, the selector 300 can be configured to output the internal reference voltage ivref when a significant amount of noise exists, and can output the external reference voltage evref when little noise exists.

Figure 5:
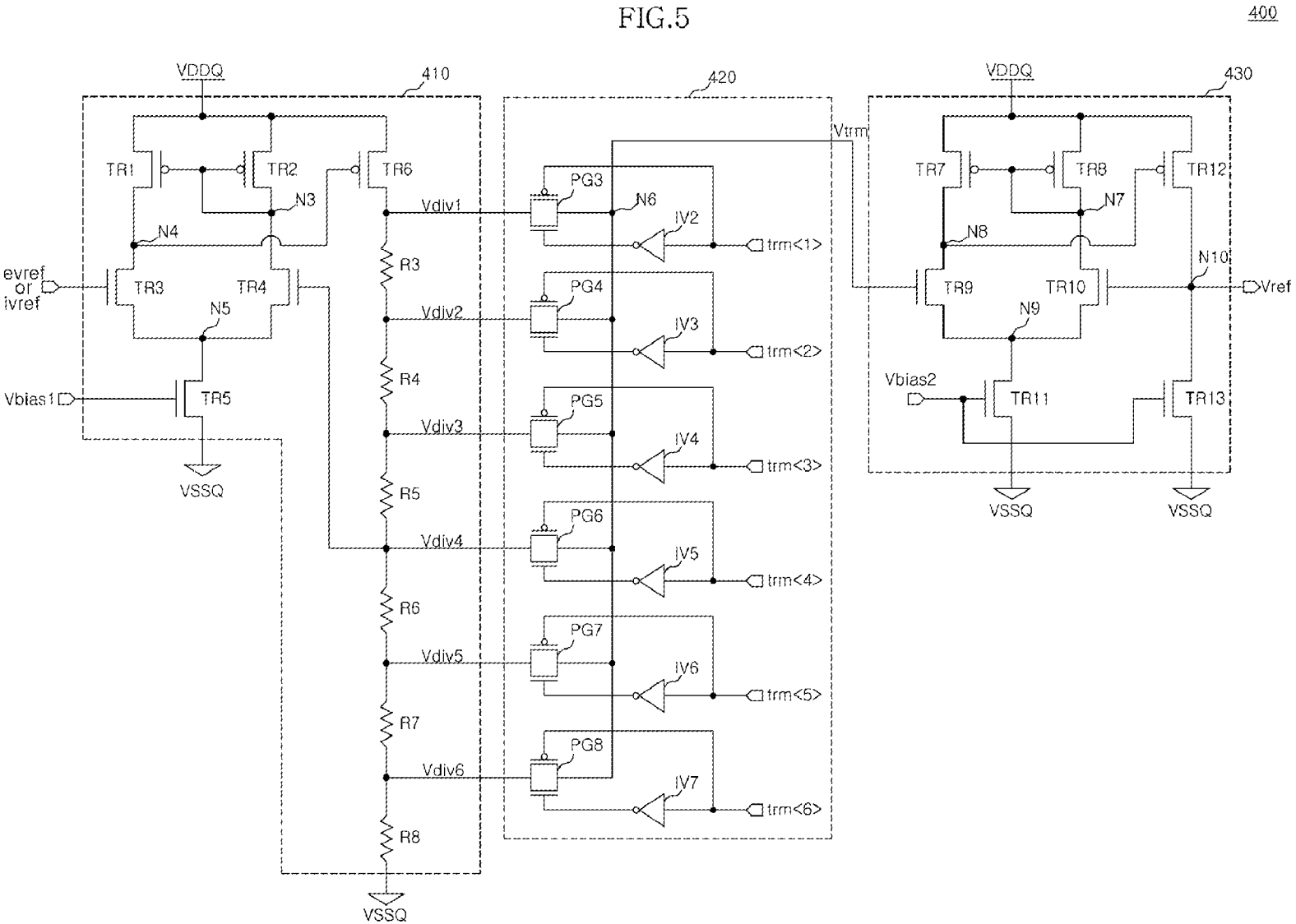
FIG. 5 is a diagram illustrating the detailed configuration of a first trimming block that can be included in the circuit illustrated in FIG. 2, in accordance with one embodiment.

FIG. 5 is a diagram illustrating the detailed configuration of the first trimming block shown in FIG. 2, in accordance with one embodiment. In FIG. 5, for example, the number of trimming signals 'trm<1:m>' are six. That is, m is six. Referring to FIG. 5, the first trimming block 400 can include a voltage divider 410, a first multiplexer unit 420, and a buffer unit 430.

The voltage divider 410 can be configured to divide the external power supply voltage VDDQ in response to the external reference voltage evref or the internal reference voltage ivref from selector 300 and generate first to sixth divided voltages Vdiv1 to Vdiv6. The voltage divider 410 can include third to fifth nodes N3 to N5, first to sixth transistors TR1 to TR6, and third to eighth resistors R3 to R8.

The first transistor TR1 has a gate which can be connected to the third node N3, a source to which the external power supply voltage VDDQ can be applied, and a drain which can be connected to the fourth node N4. The second transistor TR2 has a gate and a drain which can be connected to the third node N3, and a source to which the external power supply voltage VDDQ can be applied. The third transistor TR3 has a gate to which the external reference voltage evref or the internal reference voltage ivref can be applied, a drain which can be connected to the fourth node N4, and a source which can be connected to the fifth node N5. The fourth transistor TR4 has a gate to which the fourth divided voltage Vdiv4 can be applied, a drain which can be connected to the third node N3, and a source which can be connected to the fifth node N5.

The fifth transistor TR5 has a gate to which a first bias voltage Vbias1 can be applied, a drain which can be connected to the fifth node N5, and a source which can be connected to the ground. The sixth transistor TR6 has a gate which can be connected to the fourth node N4, a drain to which the first divided voltage Vdiv1 can be applied, and a source to which the external power supply voltage VDDQ can be applied.

The third to eighth resistors R3 to R8 can be connected in series between the drain of the sixth transistor TR6 and the ground. The first to sixth divided voltages Vdiv1 to Vdiv6 can be output from connection nodes between the sixth transistor TR6 and the third to eighth resistors R3 to R8, respectively.

The first multiplexer unit 420 can be configured to output one from among the first to sixth divided voltages Vdiv1 to Vdiv6 as a trimming voltage Vtrm in response to the first to sixth trimming signals trm<1:6>. The first multiplexer unit 420 can include a sixth node N6, second to seventh inverters IV2 to IV7, and third to eighth pass gates PG3 to PG8.

To the sixth node N6, the trimming voltage Vtrm can be applied. The second to seventh inverters IV2 to IV7 can be configured to receive the first to sixth trimming signals 'trm<1:6>,' respectively.

The third to eighth pass gates PG3 to PG8 can be configured to transmit the first to sixth divided voltages Vdiv1 to Vdiv6 to the sixth node N6 in response to output signals of the second to seventh inverters IV2 to IV7 and the first to sixth trimming signals 'trm<1:6>,' respectively.

The buffer unit 430 can be configured to buffer the trimming voltage Vtrm and generate the reference voltage Vref. The buffer unit 430 can include seventh to tenth node N7 to N10, and seventh to thirteenth transistors TR7 to TR13.

To the tenth node N10, the reference voltage Vref can be applied. The seventh transistor TR7 has a gate which can be connected to the seventh node N7, a source to which the external power supply voltage VDDQ can be applied, and a drain which can be connected to the eighth node N8. The eighth transistor TR8 has a gate and a drain which can be connected to the seventh node N7, and a source to which the external power supply voltage VDDQ can be applied. The ninth transistor TR9 has a gate to which the trimming voltage Vtrm can be applied, a drain which can be connected to the eighth node N8, and a source which can be connected to the ninth node N9. The tenth transistor TR10 has a gate which can be connected to the tenth node N10, a drain which can be connected to the seventh node N7, and a source which can be connected to the ninth node N9. The eleventh transistor TR11 has a gate to which a second bias voltage Vbias2 can be applied, a drain which can be connected to the ninth node N9, and a source which can be connected to the ground. The twelfth transistor TR12 has a gate which can be connected to the eighth node N8, a source to which the external power supply voltage VDDQ can be applied, and a drain which can be connected to the tenth node N10. The thirteenth transistor TR13 has a gate to which the second bias voltage Vbias2 can be applied, a drain which can be connected to the tenth node N10, and a source which can be connected to the ground.

In the first trimming block 400 having the above configuration, the voltage divider 410 can be configured to generate the first to sixth divided voltages Vdiv1 to Vdiv6. Among the six voltages, the first divided voltage Vdiv1 can be at the highest level, and the sixth divided voltage Vdiv6 can be at the lowest level. The ratio between the levels of the first to sixth divided voltages Vdiv1 to Vdiv6 can be determined according to the resistance ratio of the third to eighth resistors R3 to R8 of the voltage divider 410. The levels of the first to sixth divided voltages Vdiv1 to Vdiv6 can be regulated according to the level of the external reference voltage evref or the internal reference voltage ivref.

Among the first to sixth trimming signals 'trm<1:6>,' one trimming signal can be enabled at the low level. The first multiplexer unit 420 can be configured to output one from among the first to sixth divided voltages Vdiv1 to Vdiv6 as the trimming voltage Vtrm in response to an enabled signal among the first to sixth trimming signals 'trm<1:6>.'

Thereafter, the buffer unit 430 can be configured to buffer the trimming voltage Vtrm and generate the reference voltage Vref. At this time, if the level of the trimming voltage Vtrm is changed, the level of the reference voltage Vref can also be changed.

As described above, the first trimming block 400 can be configured to divide the external power supply voltage VDDQ in response to the external reference voltage evref or the internal reference voltage ivref and generate a plurality of divided voltages Vdiv1 to Vdiv6. Thereafter, one from among the plurality of divided voltages Vdiv1 to Vdiv6 can be selected in response to one of the plurality of trimming signals 'trm<1:6>,' and the selected voltage is buffered, thereby generating the reference voltage Vref. That is, it seems that the level of the external reference voltage evref or the internal reference voltage ivref is trimmed to generate the reference voltage Vref.

When the external reference voltage evref has a significant amount of noise, the selector 300 can be configured to select the internal reference voltage ivref, and accordingly the inflow of external noise can be cut off. In addition, the first trimming block 400 can be configured to finely regulate the level of the internal reference voltage ivref to generate the reference voltage Vref. Therefore, even if the level of the external power supply voltage VDDQ is changed due to internal noise, there may be no influence on the reference voltage Vref. As a result, even if noise flows into the external reference voltage evref or internal noise is generated, the first to n-th input buffers 500-<1:*n*> can operate stably without being influenced by noise.

Figure 6:
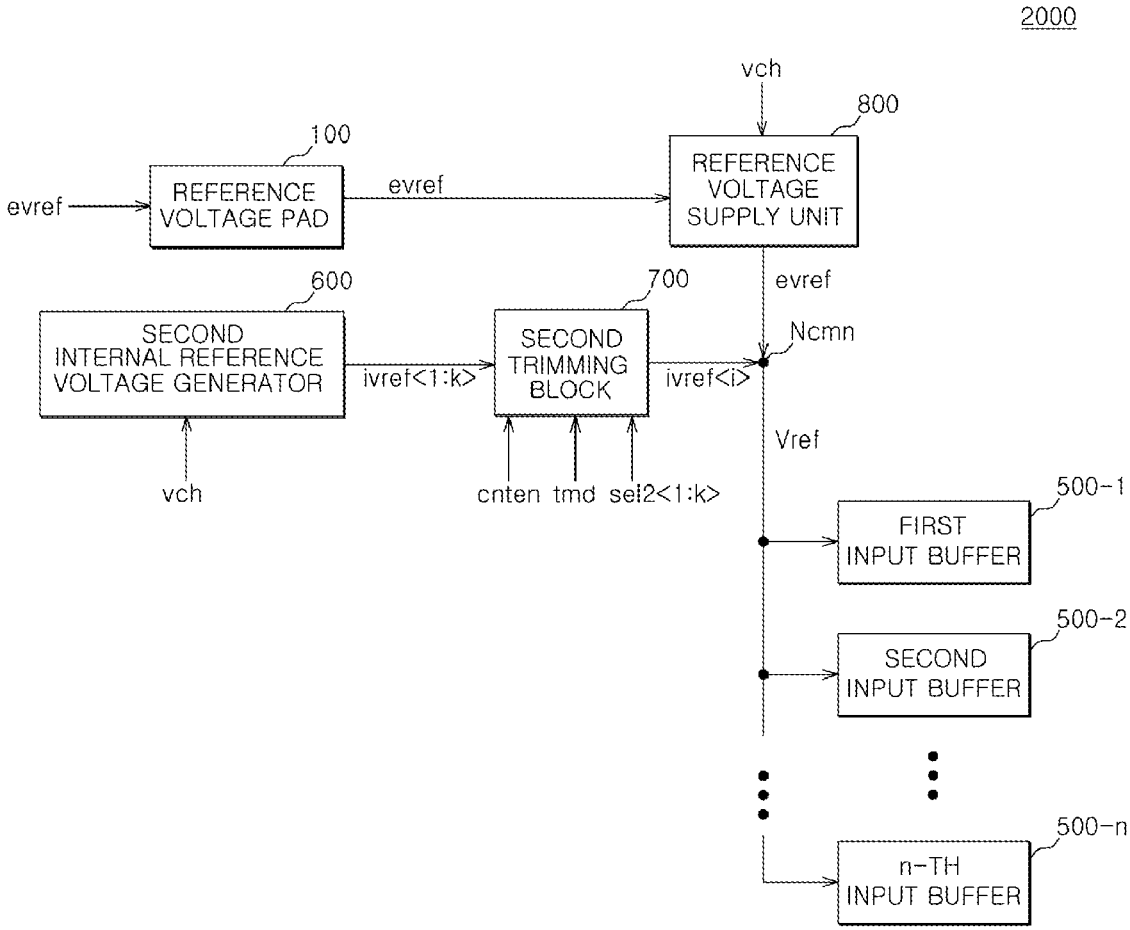
FIG. 6 is a block diagram illustrating the configuration of a semiconductor integrated circuit, in accordance with one embodiment.

Referring to FIG. 6, a semiconductor integrated circuit 2000 can include a reference voltage pad 100, a second internal reference voltage generator 600, a second trimming block 700, a reference voltage supply unit 800, and first to n-th input buffers 500-<1:*n*>, in accordance with one embodiment.

The reference voltage pad 100 can be configured to receive an external reference voltage evref and supply the external reference voltage to the inside of the semiconductor integrated circuit. The second internal reference voltage generator 600 can be configured to divide the external power supply voltage VDDQ in response to a voltage change signal 'vch' and generate internal reference voltages ivref<1:*k*> (where k is a natural number). The second trimming block 700 can be configured to output one internal reference voltage ivref<i> from among the k internal reference voltages ivref<1:*k*> to a common node Ncmn in response to a count enable signal 'cnten,' a test mode signal 'tmd,' and k second selection signals 'sel2<1:k>.' The reference voltage supply unit 800 can be configured to control supply of the external reference voltage evref to the common node Ncmn in response to the test mode signal 'tmd.' To the common node Ncmn, a reference voltage Vref can be applied. The reference voltage Vref can be supplied to the first to n-th input buffers 500-<1:*n*>, and the first to n-th input buffers 500-<1:*n*> buffer data by using the reference voltage Vref.

The voltage change signal 'vch' can be enabled according to which of the external reference voltage evref and the one internal reference voltage ivref<i> is used to generate the reference voltage Vref. The voltage change signal 'vch' can be implemented with a signal generated according to whether or not a fuse is short-circuited, a signal from the MRS, or a signal input from the outside. The test mode signal 'tmd' can be input from the outside and enabled during the test mode. The count enable signal 'cnten' can be toggled at a predetermined cycle, and input to a counter in the second trimming block 700. The second selection signals 'sel2<1:k>' can be implemented with signals generated according to whether or not fuses are short-circuited, signal from the MRS, or signals input from the outside during the test mode.

If the voltage change signal 'vch' is disabled, the reference voltage supply unit 800 can be activated, and the second internal reference voltage generator 600 can be inactivated. Accordingly, the external reference voltage evref can be supplied to the first to n-th input buffers 500-<1:*n*> as the reference voltage Vref. When the semiconductor integrated circuit 2000 is not influenced by external voltage noise so much and/or if the voltage change signal 'vch' is disabled, the reference voltage Vref can be generated by using the external reference voltage evref in such a manner.

Meanwhile, if the voltage change signal 'vch' is enabled, the reference voltage supply unit 800 can be configured to cut off supply of the external reference voltage evref to the common node Ncmn. In this case, the second internal reference voltage generator 600 can be configured to generate the internal reference voltages ivref<1:*k*>. Then, if the test mode signal 'tmd' is enabled, the second trimming block 700 can be configured to perform counting and decoding by using the count enable signal 'cnten,' and accordingly one internal reference voltage ivref<i> of the internal reference voltages ivref<1:*k*> is selected and output. If the test mode signal 'tmd' is disabled, the second trimming block 700 can be configured to select and output one internal reference voltage ivref<i> from among the k internal reference voltages ivref<1:*k*> in response to the k second selection signals 'sel2<1:k>.'

As such, the semiconductor integrated circuit 2000 can change an operation to generate the reference voltage Vref in response to the voltage change signal vch, in accordance with one embodiment. Therefore, according to how external noise exists, the external reference voltage evref or the internal reference voltage ivref<i> can be selectively used as the reference voltage Vref.

When there is influence of external noise on the external reference voltage evref, the voltage change signal 'vch' can be enabled to enter the test mode, the optimum internal reference voltage ivref<i> can be extracted to control the k second selection signals 'sel2<1:k>.' Therefore, the reference voltage Vref at a stable level can be implemented.

Figure 7:
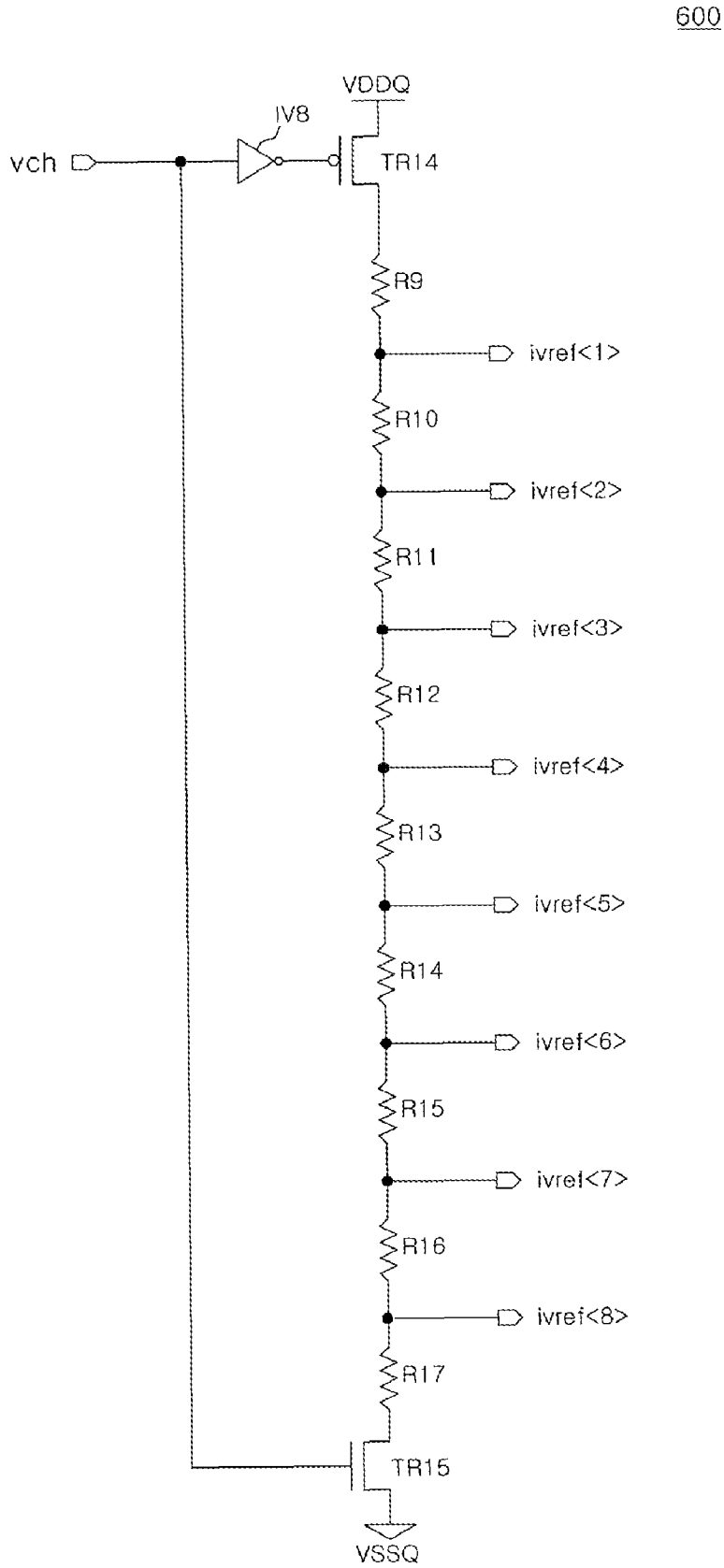
FIG. 7 is a diagram illustrating the detailed configuration of a second internal reference voltage generator that can be included in the circuit illustrated in FIG. 6, in accordance with one embodiment.

Referring to FIG. 7, the second internal reference voltage generator 600 can include an eighth inverter IV8, fourteenth and fifteenth transistors TR14 and TR15, and ninth to seventeenth resistors R9 to R17.

The eighth inverter IV8 can be configured to receive the voltage change signal 'vch.' The fourteenth transistor TR14 has a gate to which an output signal of the eighth inverter IV8 can be input, and a source to which the external power supply voltage VDDQ can be applied. The fifteenth transistor TR15 has a gate to which the voltage change signal 'vch' can be input, and a source which can be connected to the ground. The ninth to seventeenth resistors R9 to R17 can be connected in series between a drain of the fourteenth transistor TR14 and a drain of the fifteenth transistor TR15. The first to eighth internal reference voltages ivref<1:8> are output from nodes between the ninth to seventeenth resistors R9 to R17, respectively.

With this configuration, the second internal reference voltage generator 600 can be inactivated if the voltage change signal 'vch' is disabled. Meanwhile, if the voltage change signal 'vch' is enabled, the second internal reference voltage generator 600 can be configured to divide the external power supply voltage VDDQ to generate the first to eighth internal reference voltages ivref<1:8>. The levels of the first to eighth internal reference voltages ivref<1:8> can be determined according to the resistance ratio of the ninth to seventeenth resistors R9 to R17.

Figure 8:
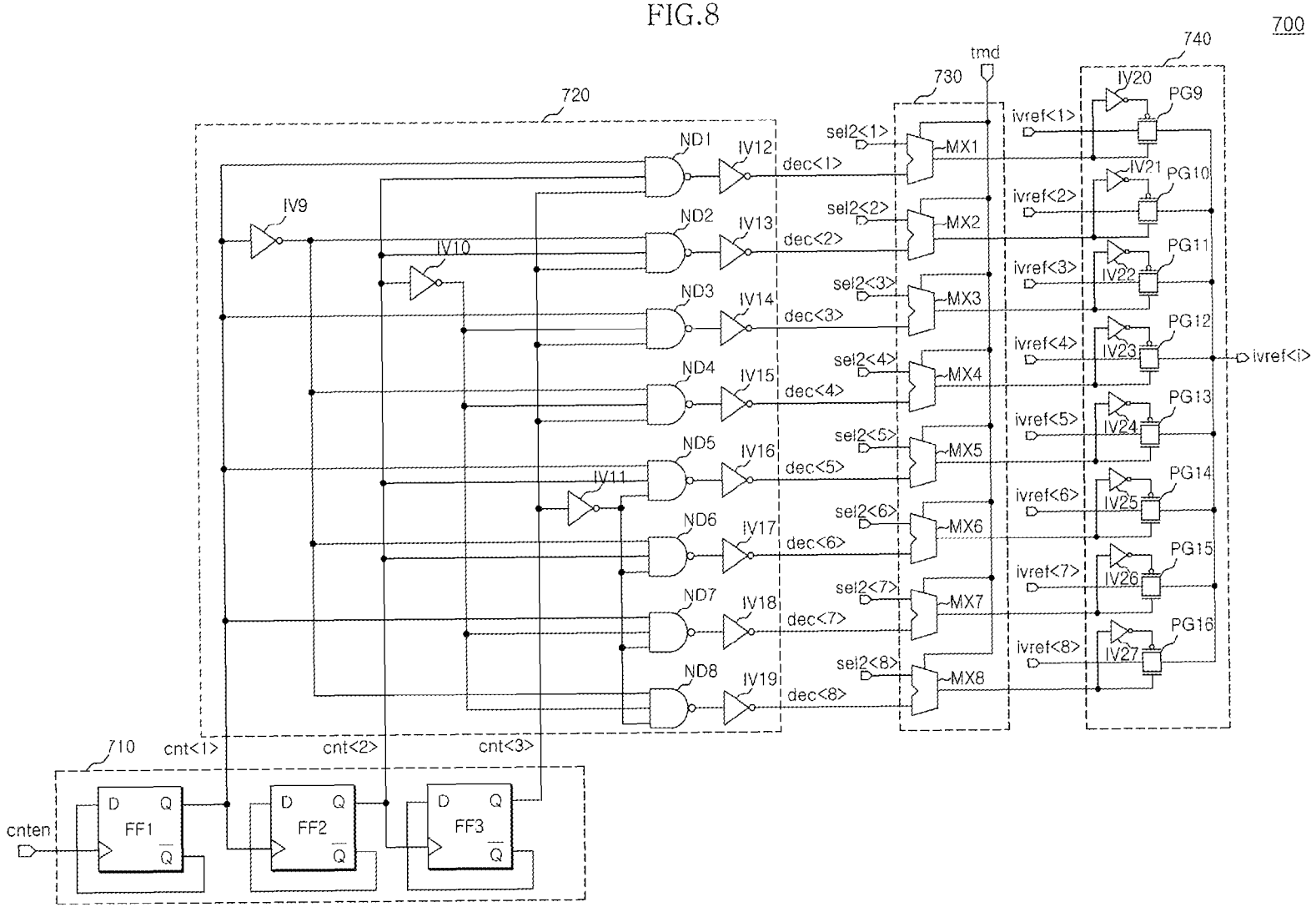
FIG. 8 is a diagram illustrating the detailed configuration of a second trimming block that can be included in the circuit illustrated in FIG. 6, in accordance with one embodiment.

FIG. 8 is a diagram illustrating the detailed configuration of the second trimming block 700 shown in FIG. 6, in accordance with one embodiment. In FIG. 8, the number of second selection signals 'sel2<1:k>' is eight, the second selection signals 'sel2<1:8>' are illustrated. Referring to FIG. 8, the second trimming block 700 can include counter 710, a decoder 710, a second multiplexer unit 730, and a switching unit 740.

The counter 710 can be configured to perform counting in response to the count enable signal 'cnten' and generate first to third count signals 'cnt<1:3>.' The counter 710 can include first to third flip-flops FF1 to FF3.

The first flip-flop FF1 can be fed back with an output signal from a negative output terminal /Q through an input terminal D in response to the count enable signal 'cnten' and output the first count signal 'cnt<1>' through a positive output terminal Q. The second flip-flop FF2 can be fed back with an output signal from a negative output terminal /Q in response to the first count signal 'cnt<1>' through an input terminal D and output the second count signal 'cnt<2>' through a positive output terminal Q. The third flip-flop FF3 can be fed back with an output signal from a negative output terminal /Q through an input terminal D in response to the second count signal 'cnt<2>' and output the third count signal 'cnt<3>' through a positive output terminal Q.

The decoder 710 can be configured to decode the first to third count signals 'cnt<1:3>' and generate first to eighth decoded signals 'dec<1:8>.' The decoder 710 can include first to eighth NAND gates ND1 to ND8, and ninth to nineteenth inverters IV9 to IV19.

The ninth inverter IV9 can be configured to receive the first count signal 'cnt<1>.' The tenth inverter IV10 can be configured to receive the second count signal 'cnt<2>.' The eleventh inverter IV11 can be configured to receive the third count signal 'cnt<3>.'

The first NAND gate ND1 can be configured to receive the first count signal 'cnt<1>,' the second count signal 'cnt<2>,' and the third count signal 'cnt<3>.' The twelfth inverter IV12 can be configured to receive an output signal of the first NAND gate ND1 and output the first decoded signal 'dec<1>.' The second NAND gate ND2 can be configured to receive an output signal of the ninth inverter IV9, the second count signal 'cnt<2>,' and the third count signal 'cnt<3>.' The thirteenth inverter IV13 can be configured to receive an output signal of the second NAND gate ND2 and output the second decoded signal 'dec<2>.' The third NAND gate ND3 can be configured to receive the first count signal 'cnt<1>,' an output signal of the tenth inverter IV10, and the third count signal 'cnt<3>.' The fourteenth inverter IV14 can be configured to receive an output signal of the third NAND gate ND3 and output the third decoded signal 'dec<3>.' The fourth NAND gate ND4 can be configured to receive the output signal of the ninth inverter IV9, the output signal of the tenth inverter IV10, and the third count signal 'cnt<3>.' The fifteenth inverter IV15 can be configured to receive an output signal of the fourth NAND gate ND4 and output the fourth decoded signal 'dec<4>.'

The fifth NAND gate ND5 can be configured to receive the first count signal 'cnt<1>,' the second count signal 'cnt<2>,' and an output signal of the eleventh inverter IV11. The sixteenth inverter IV16 can be configured to receive an output signal of the fifth NAND gate ND5 and output the fifth decoded signal 'dec<5>.' The sixth NAND gate ND6 can be configured to receive the output signal of the ninth inverter IV9, the second count signal 'cnt<2>,' and the output signal of the eleventh inverter IV11. The seventeenth inverter IV17 can be configured to receive an output signal of the sixth NAND gate ND6 and output the sixth decoded signal 'dec<6>.' The seventh NAND gate ND7 can be configured to receive the first count signal 'cnt<1>,' the output signal of the tenth inverter IV10, and the output signal of the eleventh inverter IV11. The eighteenth inverter IV18 can be configured to receive an output signal of the seventh NAND gate ND7 and output the seventh decoded signal 'dec<7>.' The eighth NAND gate ND8 can be configured to receive the output signal of the ninth inverter IV9, the output signal of the tenth inverter IV10, and the output signal of the eleventh inverter IV11. The nineteenth inverter IV19 can be configured to receive an output signal of the eighth NAND gate ND8 and outputs the eighth decoded signal 'dec<8>.'

The second multiplexer unit 730 can be configured to selectively pass the first to eighth decoded signals 'dec<1:8>' or the 8 second selection signals 'sel2<1:8>' in response to the test mode signal 'tmd.' The second multiplexer unit 730 can include first to eighth multiplexers MX1 to MX8.

The first to eighth multiplexers MX1 to MX8 can be configured to pass the first to eighth decoded signals 'dec<1:8>' or the second selection signals 'sel2<1:8>' in response to the test mode signal 'tmd,' respectively.

The switching unit 740 can be configured to output one internal reference voltage ivref<i> from among the first to eighth internal reference voltages ivref<1:8> in response to the 8 signals (that is, the first to eighth decoded signals 'dec<1:8>' or the second selection signals 'sel2<1:8>') output from the second multiplexer unit 730. The switching unit 740 can include twentieth to twenty-seventh inverters IV20 to IV27, and ninth to sixteenth pass gates PG9 to PG16.

The twentieth to twenty-seventh inverters IV20 to IV27 can be configured to receive the 8 signals output from the second multiplexer unit 730, respectively. The ninth to sixteenth pass gates PG9 to PG16 can be configured to output the first to eighth internal reference voltages ivref<1:8> in response to output signals of the twentieth to twenty-seventh inverters IV20 to IV27 and the 8 signals output from the second multiplexer unit 730, respectively.

In the second trimming block 700 having the above configuration, the first to third flip-flops FF1~FF3 in the counter 710 can be configured to function as clock signal dividers. Accordingly, the first to third count signals 'cnt<1:3>' are implemented as a digital signal, in which the first count signal 'cnt<1>' is a lower bit and the third count signal 'cnt<3>' is a higher bit. The first to third count signals 'cnt<1:3>' are implemented as a signal which has an initial logic value (1, 1, 1), and the logic value is decremented by "1".

As the logic value of the first to third count signals 'cnt<1:3>' is changed, the first to eighth decoded signals 'dec<1:8>' can be sequentially enabled one at a time.

Thereafter, if the test mode signal 'tmd' is enabled, the second multiplexer unit 730 can be configured to transmit the first to eighth decoded signals 'dec<1:8>' to the switching unit 740. In this case, the first to eighth internal reference voltages ivref<1:8> can be sequentially output to the switching unit 740 one at a time.

As such, during the test mode, the second trimming block 700 can be configured to output the first to eighth internal reference voltages ivref<1:8> at different levels one at a time, and supply each internal reference voltage to the first to n-th input buffers 500-<1:*n*> as the reference voltage Vref. Thereafter, for the first to n-th input buffers 500-<1:*n*>, the level of the reference voltage Vref can be tested, thereby extracting the optimum reference voltage Vref. If the test mode is ended, the logic value of the 8 second selection signals 'sel2<1:8>' can be controlled and fixed, and accordingly one optimum internal reference voltage from among the first to eighth internal reference voltages ivref<1:8> can be used as the reference voltage Vref.

That is, the second trimming block 700 can be configured to output one internal reference voltage from among the first to eighth internal reference voltages ivref<1:8>. Accordingly, when the voltage change signal 'vch' is enabled, one internal reference voltage from among the first to eighth internal reference voltages ivref<1:8> can be used in the first to n-th input buffers 500-<1:*n*> as the reference voltage Vref. The second trimming block 700 can be configured to change the level of the reference voltage Vref during the test mode. Therefore, the reference voltage Vref can be easily used for the test of the first to n-th input buffers 500-<1:*n*>.

Figure 9A:
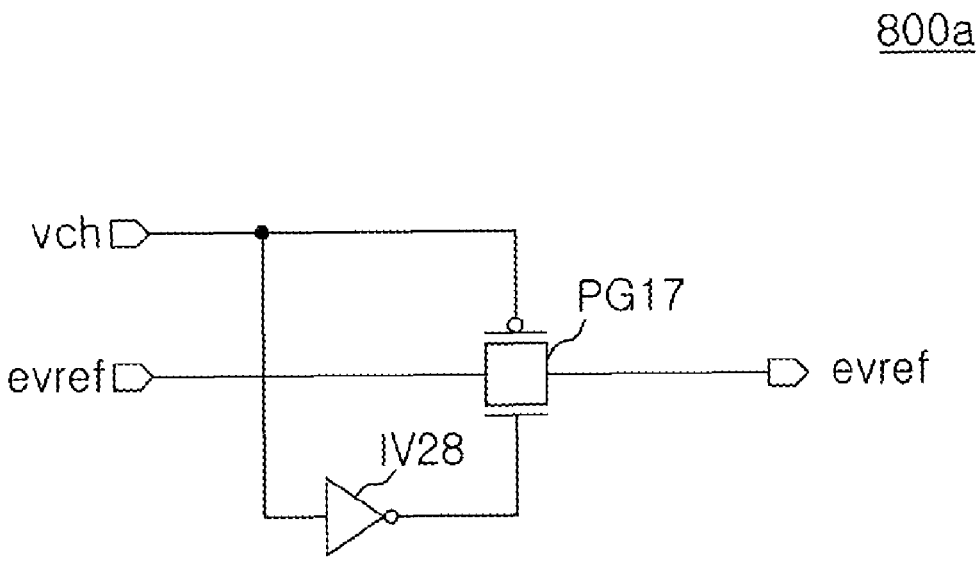
FIG. 9A is a diagram illustrating a first example of the detailed configuration of a reference voltage supply unit that can be included in the circuit illustrated in FIG. 6, in accordance with one embodiment.

Referring to FIG. 9A, the reference voltage supply unit 800*a* can include a twenty-eighth inverter IV28 and a seventeenth pass gate PG17.

The twenty-eighth inverter IV28 can be configured to receive the voltage change signal 'vch.' The seventeenth pass gate PG17 can be configured to pass the external reference voltage evref in response to the voltage change signal 'vch' and an output signal of the twenty-eighth inverter IV28.

In the reference voltage supply unit 800*a* having the above configuration, when the voltage change signal 'vch' is disabled, the external reference voltage evref can be transmitted to the common node Ncmn and used as the reference voltage Vref. Meanwhile, when the voltage change signal 'vch' is enabled, the seventeenth pass gate PG17 can be turned off. Accordingly, the external reference voltage evref output from the reference voltage supply unit 800*a* is at a meaningless level.

Figure 9B:
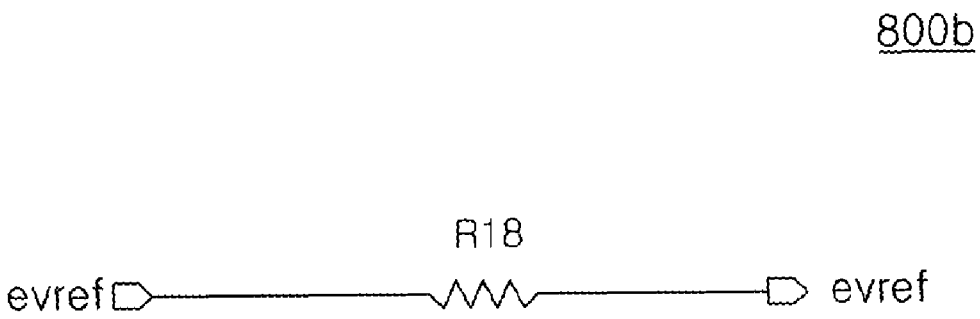
FIG. 9B is a diagram illustrating a second example of the detailed configuration of a reference voltage supply unit that can be included in the circuit illustrated in FIG. 6, in accordance with one embodiment.

Referring to FIG. 9B, the reference voltage supply unit 800*b* can include an eighteenth resistor R18. The eighteenth resistor R18 can be configured to shift down the level of the external reference voltage evref.

In the reference voltage supply unit 800*b* having the above configuration, the level-shifted external reference voltage evref can be transmitted to the common node Ncmn, regardless of the voltage change signal 'vch.' Accordingly, to the common node Ncmn, the level-shifted external reference voltage evref and the internal reference voltage ivref<i> are both applied. Then, the reference voltage Vref can be influenced by the external reference voltage evref and the internal reference voltage ivref<i>.

As described above, according to the various embodiments of semiconductor integrated circuits described herein, in order to prevent the input buffers from being erroneously operated when noise flows into the external reference voltage input through reference voltage pad, an additional internal reference voltage generator is provided. Therefore, according to how external noise exists, the external reference voltage or the internal reference voltage can be selectively supplied to the input buffers as the reference voltage. In addition, during the test mode, the level of the external reference voltage or the internal reference voltage can be trimmed. Therefore, the level of a stably usable reference voltage can be extracted. As a result, a stably usable reference voltage can be generated, regardless of noise.

It will be apparent to those skilled in the art that various modifications and changes may be made without departing from the scope and spirit of the embodiments described above. Therefore, it should be understood that the above embodiments are not limitative, but illustrative in all aspects. The scope of the embodiments described above are defined by the appended claims rather than by the description preceding them, and therefore all changes and modifications that fall within metes and bounds of the claims, or equivalents of such metes and bounds are therefore intended to be embraced by the claims.

While certain embodiments have been described above, it will be understood that the embodiments described are by way of example only. Accordingly, the apparatus and methods described herein should not be limited based on the described embodiments. Rather, the apparatus and methods described herein should only be limited in light of the claims that follow when taken in conjunction with the above description and accompanying drawings.

What is claimed is:

1. A semiconductor integrated circuit, comprising:

a reference voltage pad that is configured to receive an external reference voltage;

an internal reference voltage generator that is configured to generate a plurality of internal reference voltages by dividing a voltage in response to a voltage change signal;

a trimming block that is configured to output one of the plurality of internal reference voltages as a reference voltage; and a reference voltage supply unit that is configured to output the external reference voltage as the reference voltage if the voltage change signal is disabled, and cuts off output of the external reference voltage if the voltage change signal is enabled.

2. The semiconductor integrated circuit of claim 1, further comprising:

a plurality of input buffers that buffer data by using the reference voltage output from the trimming block or the reference voltage output from the reference voltage supply unit.

3. The semiconductor integrated circuit of claim 1, wherein enabling of the voltage change signal is determined according to whether or not the reference voltage is generated, using the external reference voltage and the internal reference voltage, and wherein the voltage change signal is a signal generated according to whether or not a fuse is short-circuited, a signal from an MRS, or a signal received from the outside of the semiconductor integrated circuit.

4. The semiconductor integrated circuit of claim 1, wherein the trimming block is configured to, if a test mode signal is enabled, perform counting and decoding, by using a count enable signal, and to select and output one from among the plurality of internal reference voltages, and if the test mode signal is disabled, to select and output. One from among the plurality of internal reference voltages in response to a plurality of selection signals.

5. The semiconductor integrated circuit of claim 4, wherein the plurality of selection signals are signals generated according to whether or not fuses are short-circuited, signals from an MRS, or signals received from the outside of the semiconductor integrated circuit.

6. The semiconductor integrated circuit of claim 5, wherein the trimming block includes:

a counter that is configured to perform counting in response to the count enable signal and generate a plurality of count signals;

a decoder that is configured to decode the plurality of count signals and generate a plurality of decoded signals;

a multiplexer unit that is configured to selectively pass the plurality of decoded signals or the plurality of selection signals in response to the test mode signal; and a switching unit that is configured to output one internal reference voltage from among the plurality of internal reference voltages in response to a plurality of signals output from the multiplexer unit.

7. A semiconductor integrated circuit, comprising:

a reference voltage pad that is configured to receive an external reference voltage;

a common node to which a reference voltage is applied;

an internal reference voltage generator that is configured to generate a plurality of internal reference voltages by voltage dividing in response to a voltage change signal;

a trimming block that is configured to supply one of the plurality of internal reference voltages to the common node; and a reference voltage supply unit that is configured to shift down the level of the external reference voltage and supply the level-shifted external reference voltage to the common node, wherein the voltage change signal is enabled according to which of the external reference voltage and the internal reference voltage is used to generate the reference voltage.

8. The semiconductor integrated circuit of claim 7, wherein the voltage change signal is implemented with a signal generated according to whether or not a fuse is short-circuited, a signal from an MRS, or a signal received from the outside of the semiconductor integrated circuit.

9. The semiconductor integrated circuit of claim 7, wherein the trimming block is configured to, if a test mode signal is enabled, perform counting and decoding by using a count enable signal, and to transmit one from among the plurality of internal reference voltages to the common node, and if the test mode signal is disabled, to transmit one from among the plurality of internal reference voltages to the common node in response to a plurality of selection signals.

10. The semiconductor integrated circuit of claim 9, wherein the plurality of selection signals are implemented with signals generated according to whether or not fuses are short-circuited, signals from an MRS, or signals received from the outside of the semiconductor integrated circuit.

11. The semiconductor integrated circuit of claim 10, wherein the trimming block includes:

a counter that is configured to perform counting in response to the count enable signal and generates a plurality of count signals;

a decoder that is configured to decode the plurality of count signals and generates a plurality of decoded signals;

a multiplexer unit that is configured to selectively pass the plurality of decoded signals or the plurality of selection signals in response to the test mode signal; and a switching unit that is configured to transmit one internal reference voltage from among the plurality of internal reference voltages to the common node in response to a plurality of signals output from the multiplexer unit.

12. The semiconductor integrated circuit of claim 10, further comprising:

a plurality of input buffers that receive the voltage applied to the common node as the reference voltage and buffer data by using the voltage.

* * * * *